United States Patent [19]

Itoh

[11] 4,016,309

[45] Apr. 5, 1977

[54] METHOD FOR TREATING PRINTED PAPER SHEETS FOR ILLUMINATED DISPLAY

[75] Inventor: Hirokazu Itoh, Nishi, Japan

[73] Assignee: First-Sha Co., Ltd., Nagoya, Japan

[22] Filed: Dec. 15, 1975

[21] Appl. No.: 640,473

[52] U.S. Cl. ..... 427/161; 40/132 R; 427/395

[51] Int. Cl.[2] ..... G09F 13/04; B05D 5/00

[58] Field of Search ..... 428/486, 918; 40/132 R, 40/135; 427/161, 395

[56] References Cited

UNITED STATES PATENTS

| | | | |
|---|---|---|---|
| 1,277,904 | 9/1918 | Gesell | 428/486 |
| 2,040,564 | 5/1936 | Rapley | 427/395 X |
| 2,233,170 | 2/1941 | Loane | 428/486 X |
| 2,646,369 | 7/1953 | Parmentier | 427/161 |

FOREIGN PATENTS OR APPLICATIONS

| | | | |
|---|---|---|---|
| 408,341 | 4/1934 | United Kingdom | 428/486 |

*Primary Examiner*—James R. Hoffman
*Attorney, Agent, or Firm*—George B. Oujevolk

[57] ABSTRACT

There is described a method for treating a paper sheet which bears on one side a printed picture image for illuminated display on a light box, wherein a treating liquid is applied on the non-printed back side of the paper sheet to impregnate liquid paraffin into the sheet to increase its light transmittivity and the sharpness of the picture image.

1 Claim, 3 Drawing Figures

METHOD FOR TREATING PRINTED PAPER SHEETS FOR ILLUMINATED DISPLAY

BACKGROUND OF THE INVENTION

This invention relates to a method for treating "light posters" or paper sheets bearing printed picture images for illuminated display.

In the production of the so-called "light poster" which has a sign or a picture image printed on one side thereof for illuminated display on a light box, it is the usual practice to coat a solution of polyvinyl chloride on the back side of the printed paper sheet to increase its light transmittivity or to provide the poster in the form of a laminate with outer layers of polyester films. However, such existing light posters are still inferior in light transmittivity and incapable of showing the signs or picture images with satisfactory sharpness. In addition, the laminated films tend to soften and peel off during use over a long period of time.

SUMMARY OF THE INVENTION

It is therefore an object of the invention to provide a method for treating paper sheets with printed signs or picture images for illuminated display, for increased light transmittivity, sharpness of picture images and resistance to heat.

It is another object of the invention to provide a method for mounting on a light box a number of same light posters which have been coated with the treating liquid under predetermined conditions, in a superposed state to avoid the influences of external light.

The above and other objects, features and advantages of the invention will become apparent from the following description and the appended claims, taken in conjunction with the accompanying drawings which show by way of example only preferred embodiments of the invention.

DESCRIPTION OF PREFERRED EMBODIMENT

Figure 1:
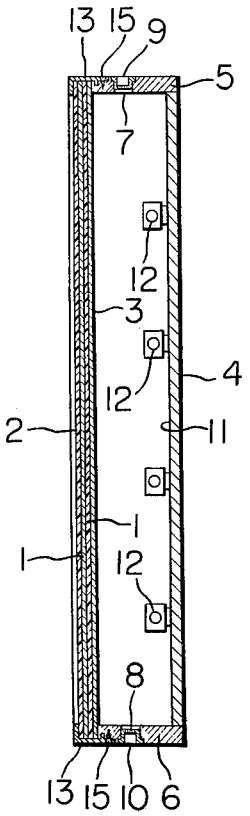
FIG. 1 is a partially sectioned front view of a light box displaying a couple of same light posters in a superposed state.
Figure 2:
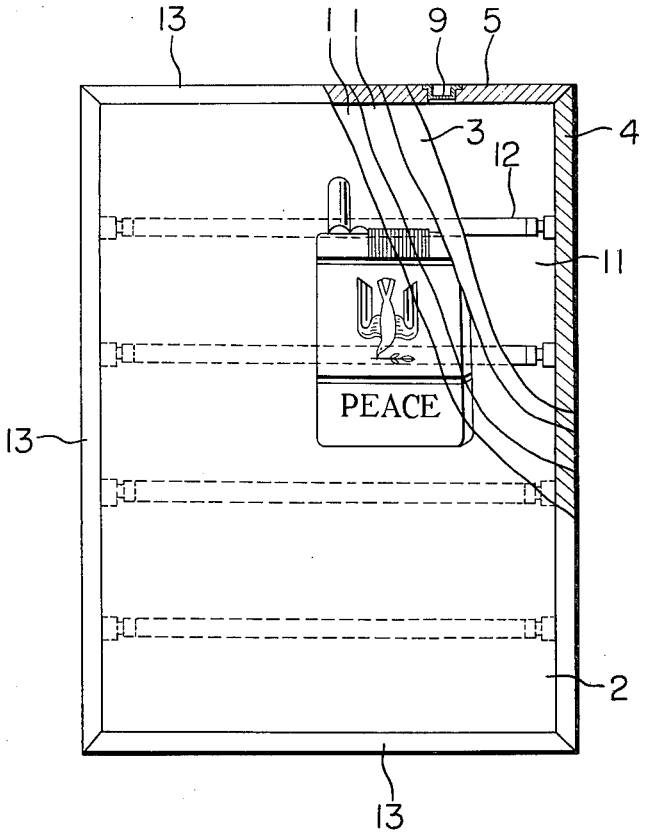
FIG. 2 is a sectional view taken on line A — A of FIG. 1.
Figure 3:
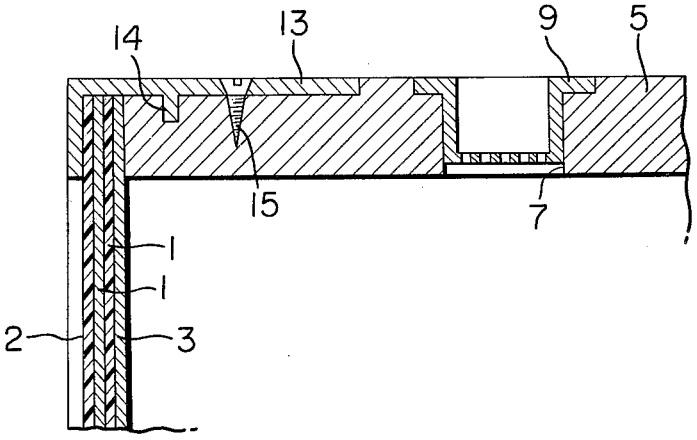
FIG. 3 is a fragmentary sectional view showing in greater detail the method of the invention.

The term "paper sheet" as herein used includes "grade paper", "art paper", "coated paper", "Japanese paper", "printing paper (photographic)", and "Kent", with a sign or picture of desired motif printed on one surface thereof for illuminated display on a light box.

According to the invention, applied on the back side of the printed paper sheet is a treating liquid comprising 60.0% to 80.0% by weight of liquid paraffin as a light transmittivity increasing agent, 0.03% to 0.06% of butyl hydroxyanisole as antioxidant, and a balance of diluent such as toluole, xylol, an ester of acetic acid, butanol and methyl isobutyl ketone. The treating liquid is applied with a brush uniformly over the back side of the printed paper sheet and dried artificially by means of an electric fan, followed by natural drying over a period of about 12 to 24 hours.

It is preferable to apply the treating liquid at an ambient temperature within the range of 5° C to 30° C and at a humidity below 75% since with an ambient temperature below 5° C the fluidity of the treating liquid will be lowered to delay its impregnation into the paper sheet considerably, giving adverse effects on the working efficiency.

On the other hand, with an ambient temperature over 30° C, the components of the treating liquid tend to evaporate in an accelerated manner at high velocities to cause undesirable variations in the proportions of the respective components of the treating liquid. While, if the humidity exceeds 75%, the moisture in the air is absorbed in the paper sheet and produces white spots in the paper sheets after the treatment, resulting in reduced light transmittivity.

After applying the treating liquid under the above-mentioned conditions, excessive liquid is removed by suitable means. The time required for the application of the treating liquid is about 30 seconds. The liquid-applied surface of the paper sheet is dried artificially by means of an electric fan or the like and then left standstill for about 12 to 24 hours for natural drying. The thus treated paper sheet has the following characteristics.

1. The light transmittivity of the paper sheet is increased to have an index of 400 after the treatment as compared with the index of 100 before the treatment.

2. The antioxidant contained in the treating liquid prevents color changes of the printed picture image and at the same time prevents the paper sheet per se from turning yellow while on display.

3. The fire catching point of the paper sheet is raised about 10° from the value before the treatment, with a lower combustion velocity to require about double the combustion time of the non-treated paper sheet.

4. The paraffin oil impregnated into the fibrous structure of paper precludes intrusion of moisture and thus the stretches and contractions of the paper sheet due to variations in the moisture content in the air.

According to the invention, two sheets of the same posters 1 which have undergone the above-described treatment are superposed one on the other and placed on a translucent milky white acrylic resin plate 3 which is mounted at an open end of a light box 4. Thereafter, a transparent synthetic resin sheet 2 of, for example, polyvinyl chloride is placed to cover the outer side of the superposed paper sheets 1, and a suitable number of sectionally L-shaped frame members 13 are fit one after another on the light box 4 and tightly secured thereto by a number of screws 15 to hold the marginal edge portions of the transparent synthetic resin sheet 2 by the flanged portions of the respective frames. As a result, the two printed paper sheets 1 are embraced securely and in an intimate condition between the inner and outer resin sheets 3 and 2. In the various figures, the reference numerals 5 and 6 designate top and bottom walls of the light box, which are formed with through holes 7 and 8, respectively, for mounting therein heat radiating members 9 and 10 each with a multitude of heat radiating perforations. A light reflecting plate 11 of aluminum foil is provided on the rear wall of the light box to reflect the light which is projected from a number of fluorescent lamps 12 toward the posters 1.

By using in a superposed state the same posters 1 which have been treated to have increased light transmittivity according to the invention, the deteriorations due to fading colors can be avoided since the inner one of the posters 1 maintains the original colors even where the colors of the outer poster have faded to some extent due to influences of external light. More than 95% of the existing light posters are mounted and displayed singly on the respective light boxes. In such a case, the black areas of the picture fade into grey disgracing the original image. In the present invention employing two sheets of same light posters in a superposed state, this can be avoided suitably and the at the same time the contrast of the picture image can be improved to a significant degree.

What is claimed is:

1. A method for displaying light posters, comprising the steps of applying a treating liquid containing 60.0% to 80.0% by weight of liquid parafin, 0.03% to 0.05% by weight of butyl hydroxyanisole and a balance of a diluent for impregnation on back sides of light posters with the same picture images, at an ambient temperature within the range of 5° C to 30° C and at a humidity below 75%, drying said light posters, superposing said posters one on the other, placing said posters on a translucent milky white resin plate, mounting said plate with said posters thereon at the open end of a light box, covering the outer side of said plate with a superposed sheet with a transparent polyvinyl chloride, and, fastening said covering resin sheet with a number of L-shaped frame members.

* * * * *